US010765927B2

(12) United States Patent
Clements

(10) Patent No.: US 10,765,927 B2
(45) Date of Patent: Sep. 8, 2020

(54) MECHANICAL SPORTS BALL CATAPULT SYSTEM

(71) Applicant: Jeremy Clements, Duluth, GA (US)

(72) Inventor: Jeremy Clements, Duluth, GA (US)

( * ) Notice: Subject to any disclaimer, the term of this patent is extended or adjusted under 35 U.S.C. 154(b) by 0 days.

(21) Appl. No.: 16/508,102

(22) Filed: Jul. 10, 2019

(65) Prior Publication Data

US 2020/0016472 A1 Jan. 16, 2020

Related U.S. Application Data

(60) Provisional application No. 62/697,260, filed on Jul. 12, 2018.

(51) Int. Cl.
*F41B 3/02* (2006.01)
*A63B 69/40* (2006.01)

(52) U.S. Cl.
CPC ..... *A63B 69/40* (2013.01); *A63B 2243/007* (2013.01)

(58) Field of Classification Search
CPC .... F41B 3/005; F41B 3/04; F41B 3/02; A63B 69/407
See application file for complete search history.

(56) References Cited

U.S. PATENT DOCUMENTS 4,261,319 A * 4/1981 Dixon ..... F41B 3/005 124/21
4,844,045 A * 7/1989 Powell ..... A63B 69/408 124/7
5,694,913 A * 12/1997 Parrott ..... F41B 3/02 124/17
6,601,574 B1 * 8/2003 Cole ..... F41B 3/02 124/17
7,415,976 B1 * 8/2008 Powell ..... F41B 3/04 124/16

* cited by examiner

*Primary Examiner* — John A Ricci
(74) *Attorney, Agent, or Firm* — Pharar Patents & Intellectual Property; Andrew A. Pharar

(57) ABSTRACT

The sports ball catapult driven by mechanical means disclosed herein may comprise a main body, an arming mechanism, a drive mechanism, a cradle mechanism, and a firing mechanism. The system is designed to operate by purely mechanical means and without power, and is launch speed and launch angle adjustable. The action of the system is such that the arming mechanism may be engaged by a user to apply tension on the cradle mechanism and drive mechanism. The user may then place a ball into the cradle mechanism, and may launch the ball from the system by engaging the firing mechanism. The engaging of the firing mechanism releases the tension in the system, causing the cradle mechanism to accelerate the ball into the air. The entire system is contained within the main body, which is designed to provide an easily moveable, lightweight, and low maintenance solution for achieving such a purpose.

15 Claims, 13 Drawing Sheets

MECHANICAL SPORTS BALL CATAPULT SYSTEM

TECHNICAL FIELD OF THE INVENTION

The present invention relates in general to exercise devices, and, more specifically, to a mechanical sports ball catapult system.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Exercise equipment, generally, may be any apparatus or device used during physical activity to enhance the experience or outcome of an exercise routine. Many exercises and sports involve a user catching or otherwise interacting with a ball travelling through the air, for example American football requires that players catch thrown passes or kicked punts, and the practicing of such interactions is necessary for the improving of a player's proficiency in the sport. A number of devices have been developed to aid in the improving of such proficiency, including automatic ball-throwing and ball-launching devices. Such devices, though, tend to utilize powered means of accelerating a ball and a sled to guide it into the air.

Examples of such devices include ball launchers and ball cannons, which are powered devices utilizing pairs of wheels spinning at high speed and accelerating a ball along an angled or curved sled. Such devices may be adjusted to alter ball speed and trajectory through the system, though tend to comprise heavy and expensive units requiring complicated system maintenance. A tension-powered mechanical design utilizing well-known catapult principles would result in a lighter, more mobile, more inexpensive, and more easily maintained ball launching system.

Thus, there is a need in the art for a mechanical sports ball catapult system. It is to these ends that the present invention has been developed.

BRIEF SUMMARY OF THE INVENTION

To minimize the limitations in the prior art, and to minimize other limitations that will be apparent upon reading and understanding the present specification, the present invention describes a mechanical sports ball catapult system.

It is an objective of the present invention to provide a mechanical sports ball catapult system that may not require electrical power to operate.

It is another objective of the present invention to provide a mechanical sports ball catapult system that may comprise a tension catapult design.

It is another objective of the present invention to provide a mechanical sports ball catapult system that may comprise a structural main body upon and within which the various components are housed and made mobile.

It is another objective of the present invention to provide a mechanical sports ball catapult system that may comprise an arming mechanism.

It is another objective of the present invention to provide a mechanical sports ball catapult system that may comprise a drive mechanism.

It is another objective of the present invention to provide a mechanical sports ball catapult system that may comprise a cradle mechanism.

It is another objective of the present invention to provide a mechanical sports ball catapult system that may comprise a firing mechanism.

It is another objective of the present invention to provide a mechanical sports ball catapult system that may comprise launch speed adjustment.

It is another objective of the present invention to provide a mechanical sports ball catapult system that may comprise launch angle adjustment.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

The preferred embodiments and examples of the claimed subject matter will hereinafter be described in conjunction with the appended drawings provided to illustrate and not to limit the scope of the claimed subject matter, where like designations denote like elements, and in which:

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary, or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention relates in general to exercise devices, and, more specifically, to a mechanical sports ball catapult system. As contemplated by the present disclosure, the combination comprises a structural main body, an arming mechanism, a drive mechanism, a cradle mechanism, and a firing mechanism. The various mechanisms may be of any design appropriate to achieve their desired functions, though may be designed as described in the various embodiments disclosed herein.

Figure 1:
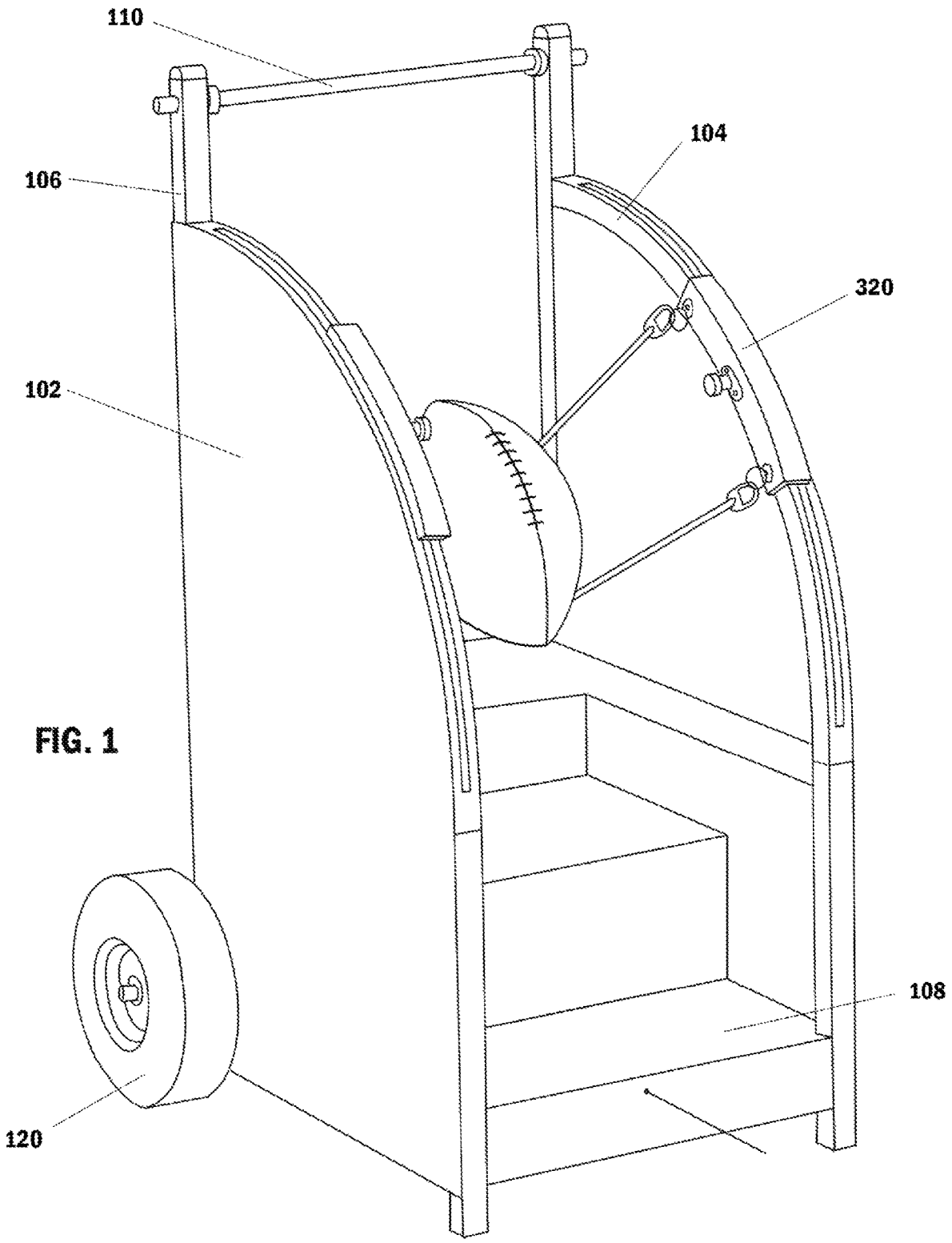
FIG. 1 illustrates an overall view of a mechanical sports ball catapult system from a front three-quarters perspective, in accordance with aspects of the present disclosure.
Figure 2:
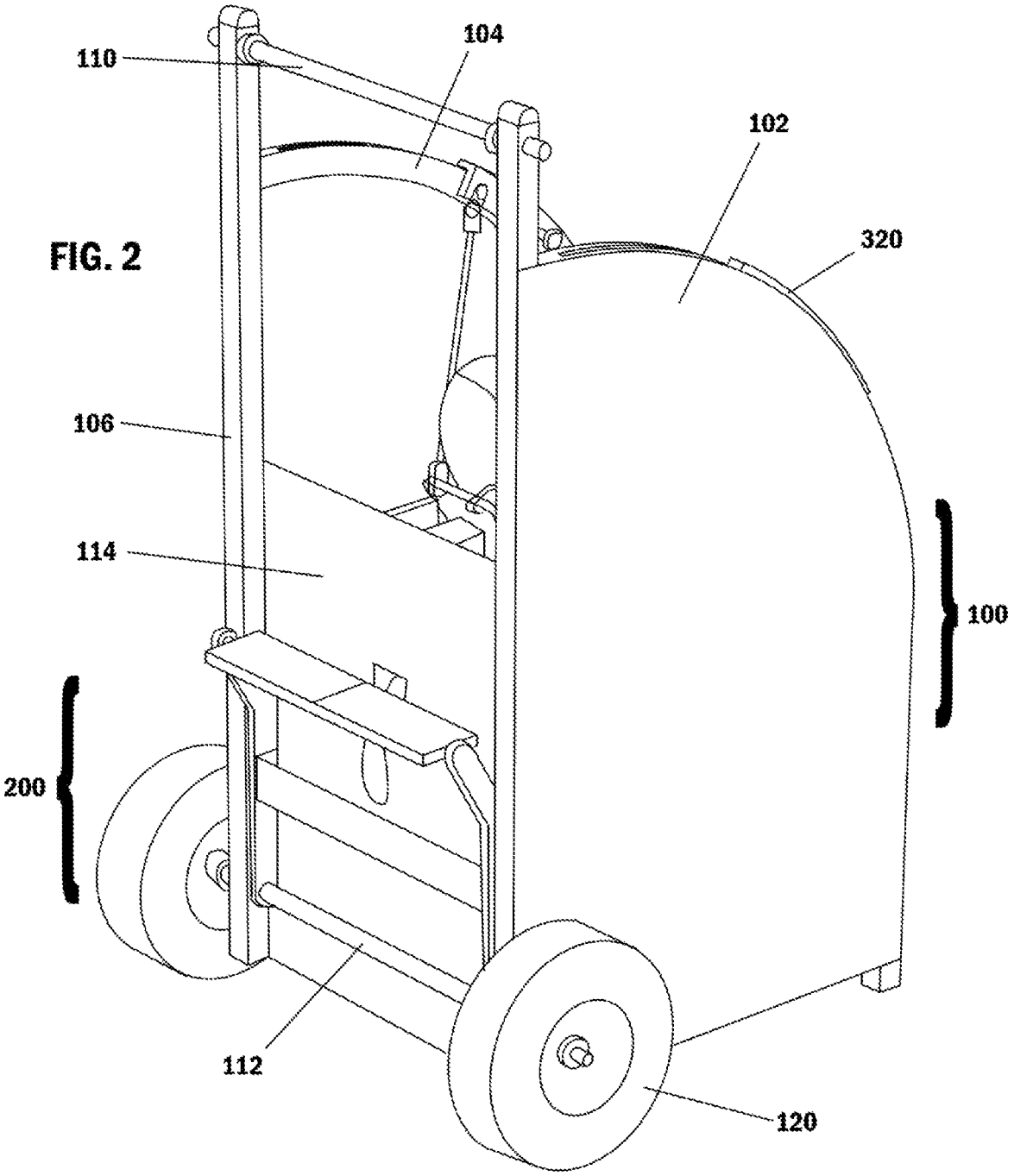
FIG. 2 illustrates an overall view of a mechanical sports ball catapult system from a rear three-quarters perspective, in accordance with aspects of the present disclosure.
Figure 3:
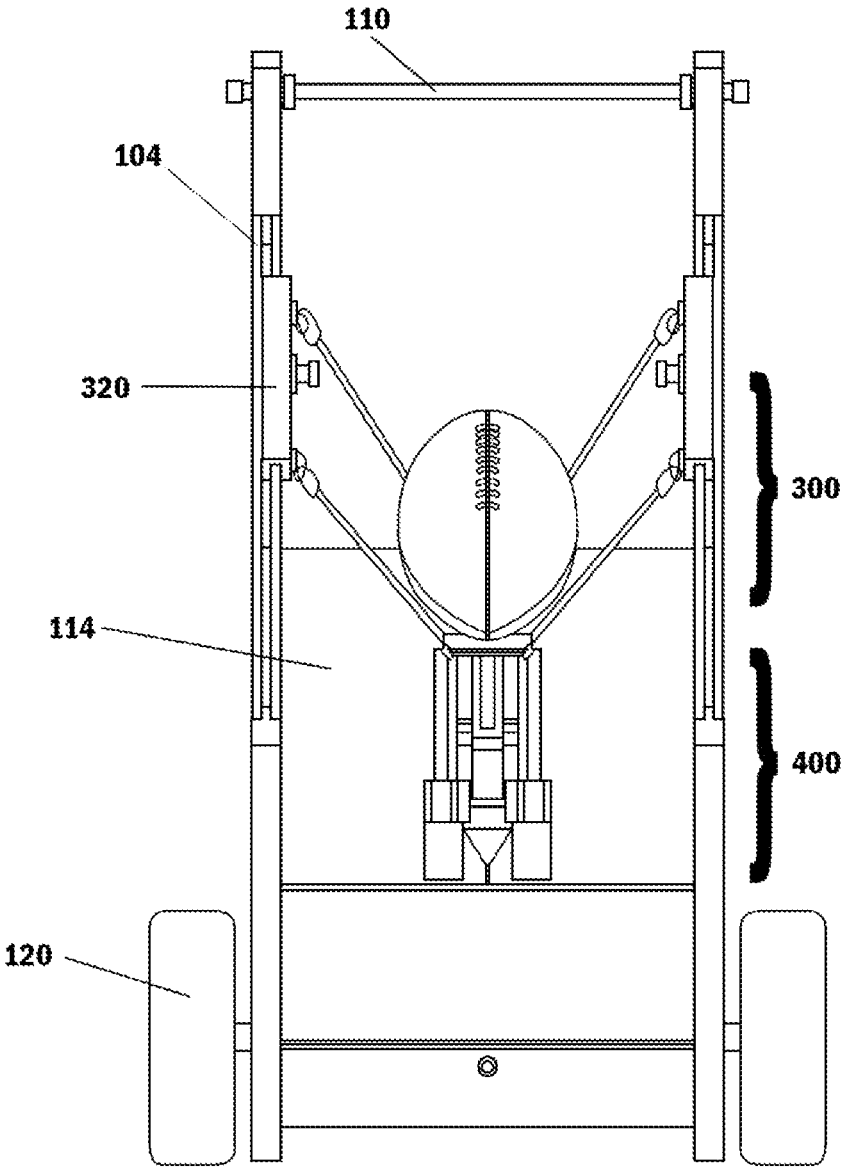
FIG. 3 illustrates an overall view of a mechanical sports ball catapult system from a front perspective, in accordance with aspects of the present disclosure.
Figure 4:
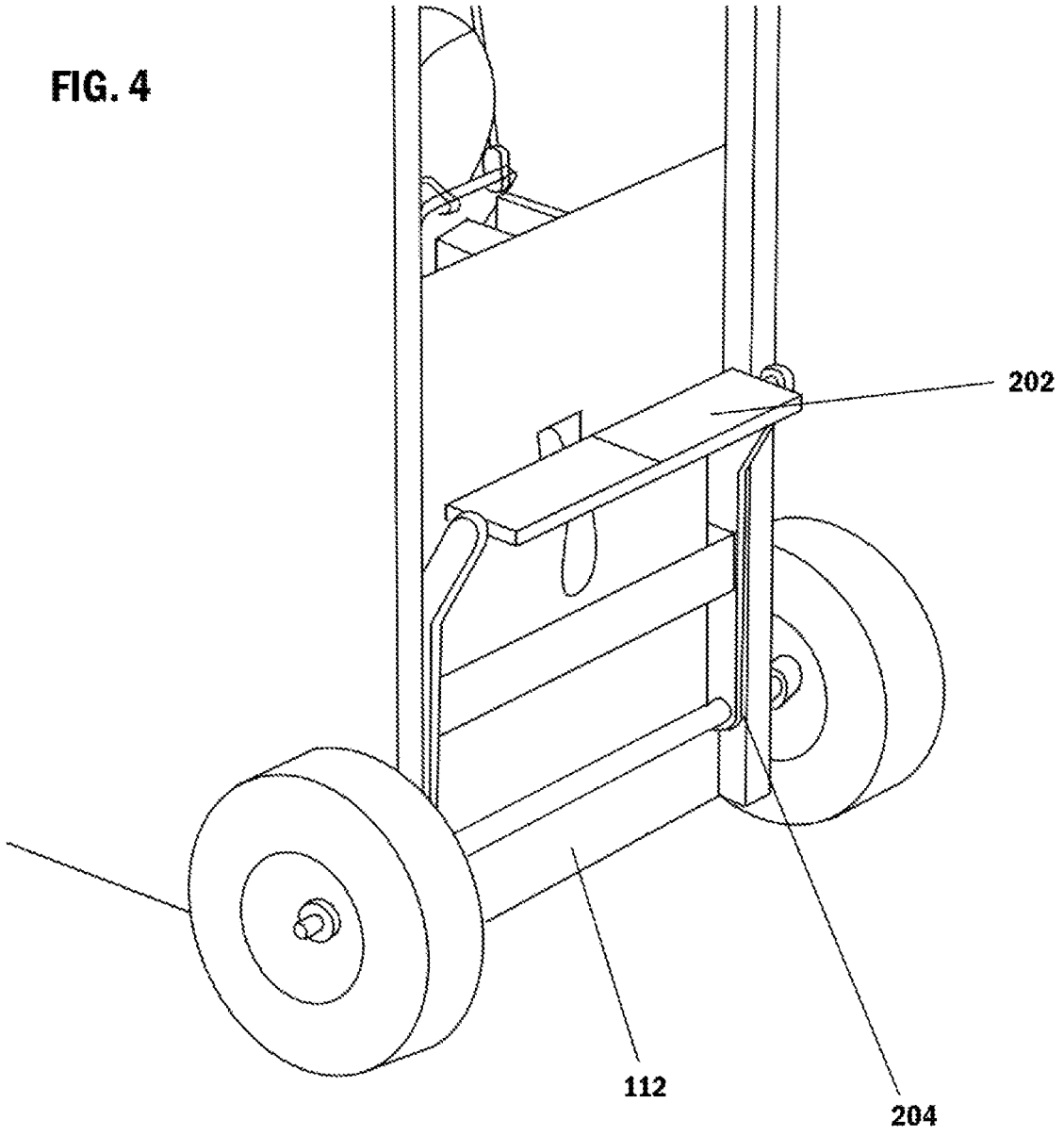
FIG. 4 illustrates a first detailed view of an arming mechanism of a sports ball catapult, in accordance with aspects of the present disclosure.
Figure 5:
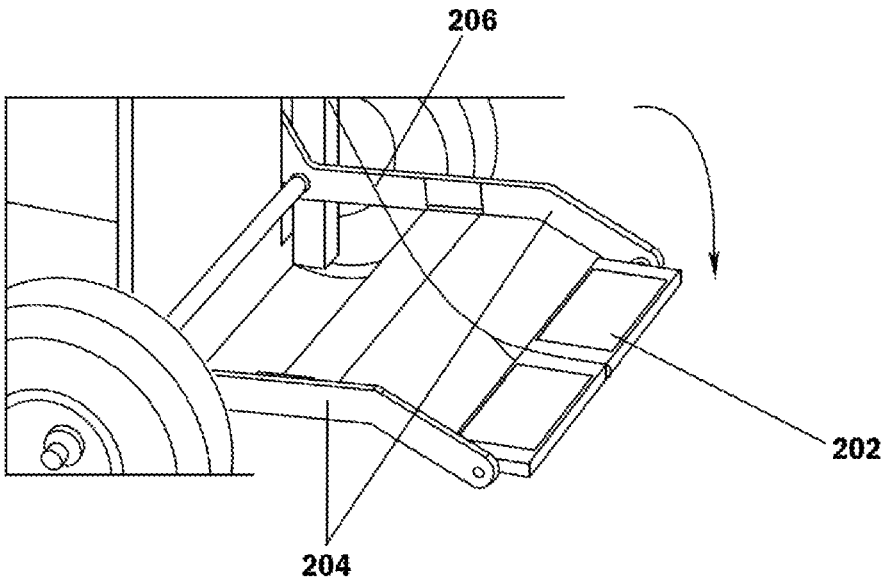
FIG. 5 illustrates a second detailed view of an arming mechanism of a sports ball catapult, in accordance with aspects of the present disclosure.
Figure 6:
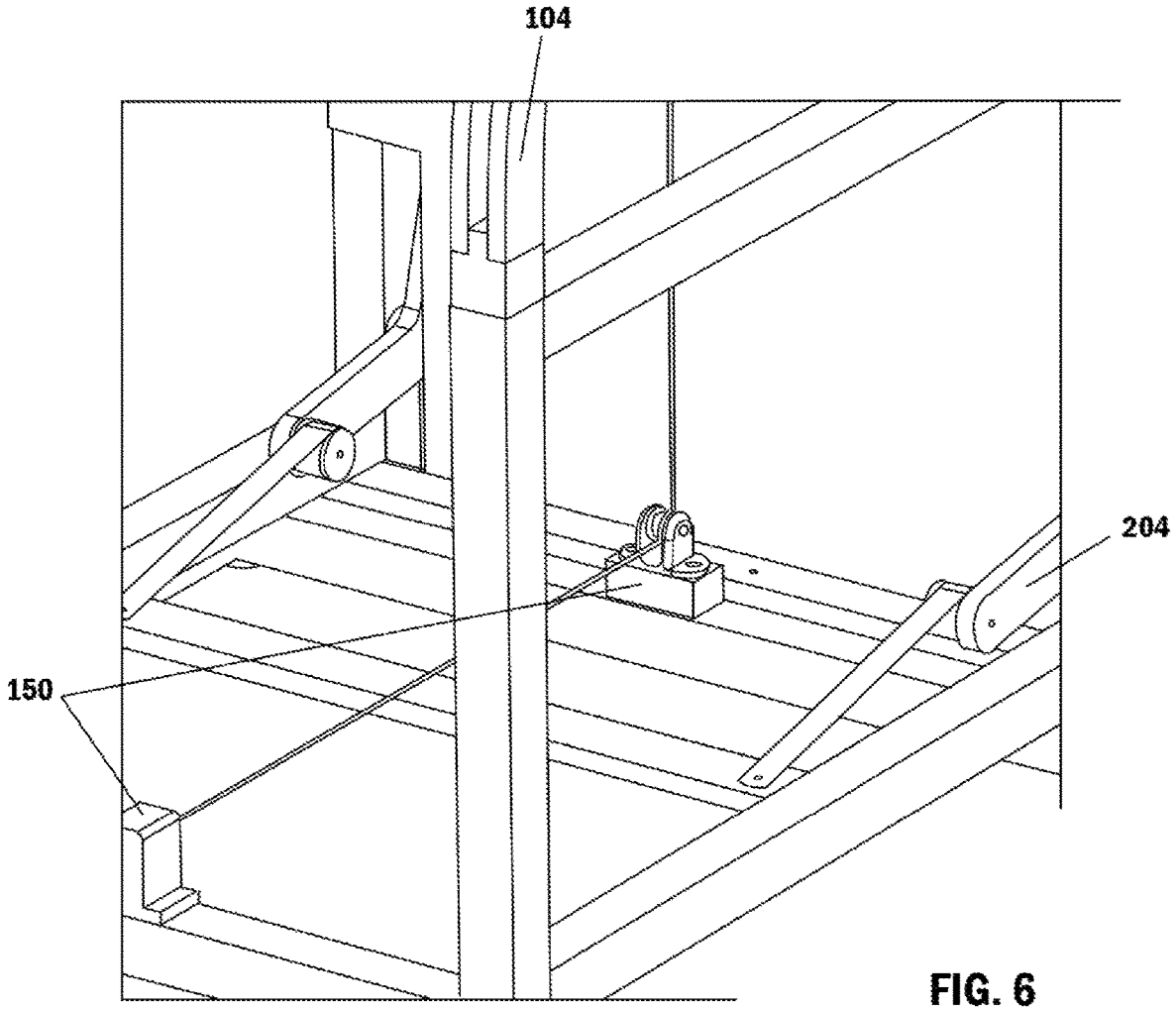
FIG. 6 illustrates a first detailed view of cable routing components of a sports ball catapult, in accordance with aspects of the present disclosure.
Figure 7:
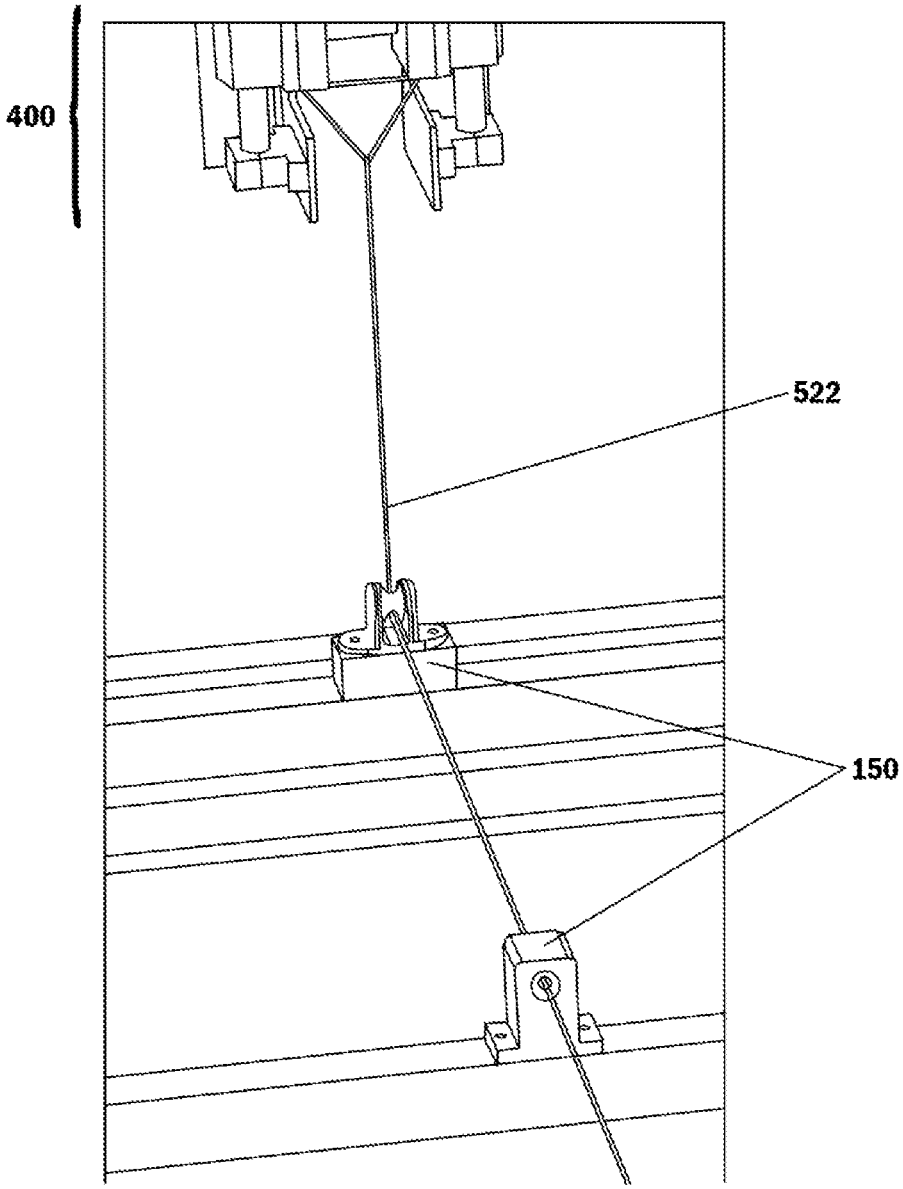
FIG. 7 illustrates a second detailed view of cable routing components of a sports ball catapult, in accordance with aspects of the present disclosure.

The illustrations of FIGS. 1 through 3 illustrate an overview of a mechanical sports ball catapult system, in accordance with aspects of the present disclosure. The figures identify a main body 100, arming mechanism 200, cradle mechanism 300, and a drive mechanism 400. The main body 100 may provide structural support and mobility capacity to the entire system, and may generally comprise a plurality of side panels 102 and a rear panel 114 attached to a system skeleton, said skeleton being defined by a plurality of cradle support frames 104, a plurality of vertical frames 106, and a plurality of horizontal frames 108 in a generally squared or rectangular construction.

A lower end of each of the plurality of vertical frames 106 may attach to an axle 112 upon which a plurality of wheels 120 may be attached, and an upper end of the plurality of vertical frames 106 may attach to a handgrip 110 so that the system may be tilted and rolled from one position to another. External to the rear panel 114 and hinging on the axle 112 may be an arming mechanism 200 (discussed further below). The plurality of cradle support frames 104 may comprise a curved frame upon which may slide a plurality of cradle angle brackets 320 (discussed further below).

The illustrations of FIGS. 4 through 7 illustrate a detailed view of an arming mechanism 200 of a mechanical sports ball catapult system, in accordance with aspects of the present disclosure. The arming mechanism 200 may comprise an arming pedal 202 attached on either side to a plurality of arming pedal arms 204 that may articulate around the axle 112. The arming pedal 202 may be engaged by a user pressing down with their foot, and may pull on an arming cord 206.

The arming cord 206 may attach at its opposite end to the cradle mechanism 300 (discussed further below). The plurality of arming pedal arms 204 may pass through the rear panel 114 and may be attached via a plurality of tensioning cords 304 to the plurality of horizontal frames 108 of the system skeleton to provide tension that returns the arming mechanism 200 to its unloaded state. A plurality of cable routing components 150 may be built into the system, as required, to prevent binding of the various cables used.

Figure 8:
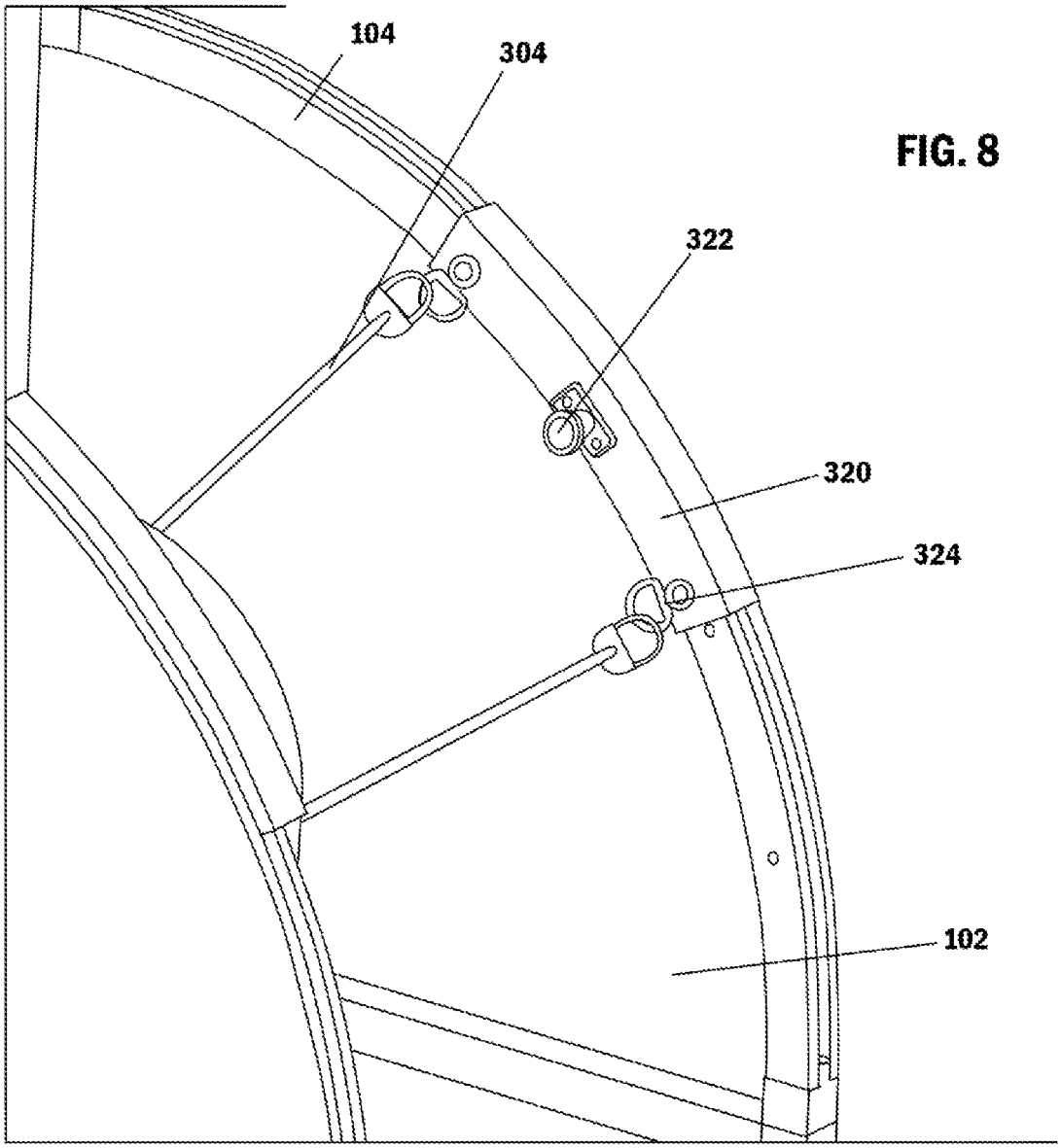
FIG. 8 illustrates a detailed view of a cradle angle adjustment means of a sports ball catapult, in accordance with aspects of the present disclosure.
Figure 9:
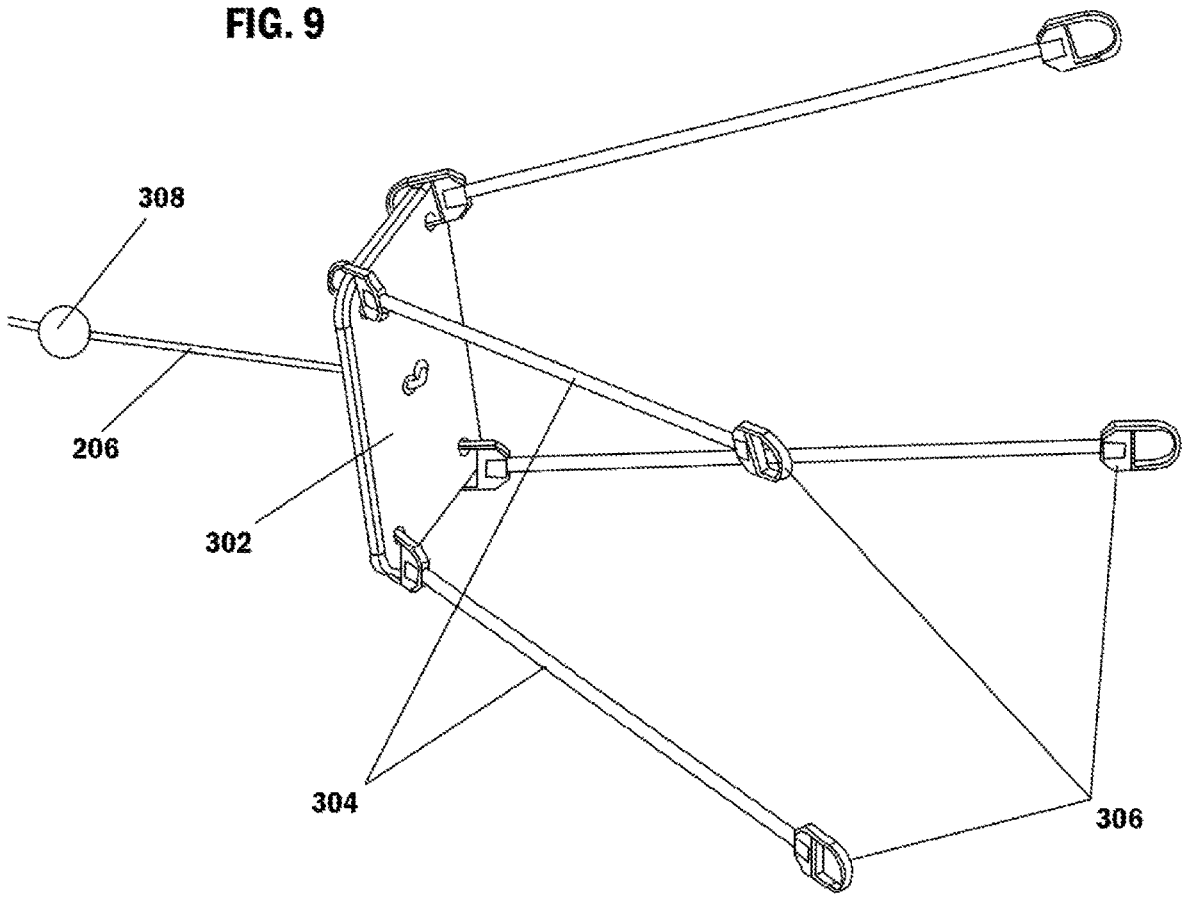
FIG. 9 illustrates a detailed view of a cradle mechanism of a sports ball catapult, in accordance with aspects of the present disclosure.

The illustrations of FIGS. 8 and 9 illustrate a detailed view of a cradle mechanism 300 of a mechanical sports ball catapult system, in accordance with aspects of the present disclosure. The cradle mechanism 300 may comprise a cradle 302, a plurality of cradle tensioning cords 304, and a plurality of fasteners 306. The arming cord 206 may be attached to the cradle 302 such that the engaging of the arming mechanism 200 by a user results in tension being applied to the cradle mechanism 300. The arming cord 206 may be attached to a retaining ball 308, which may itself engage the drive mechanism 400 to facilitate the action of the firing mechanism 500 (discussed further below).

The plurality of fasters 306 may attach to a plurality of fastener receivers 324 that may then be attached to a plurality of cradle angle brackets 320. The cradle angle brackets 320 may be attached to the cradle support frames 104 by a means for cradle angle adjustment 322 such that the cradle angle brackets 320 provide a stationary foundation against which the plurality of cradle tensioning cords 304 may be pulled to apply tension to the cradle mechanism 300. The cradle angle brackets 320 may slide along the curvature of the cradle support frames 104 and may be set at various positions on the cradle support frames 104 via the cradle angle adjustment 322 so as to alter the launch angle of a sports ball contained within the cradle mechanism 300.

Figure 10:
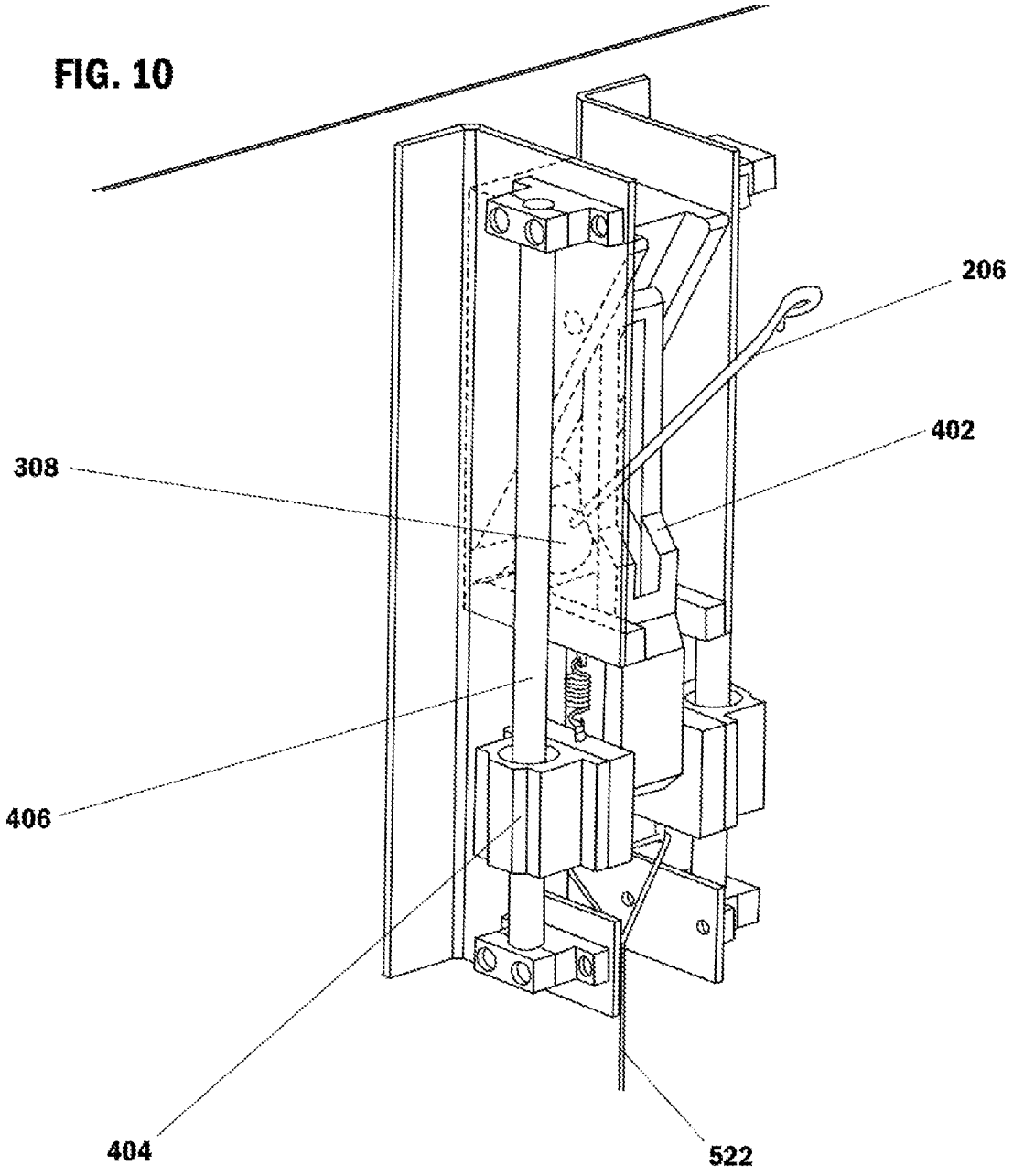
FIG. 10 illustrates a detailed view of a drive mechanism of a sports ball catapult, in accordance with aspects of the present disclosure.

The illustration of FIG. 10 illustrates a detailed view of a drive mechanism 400 of a mechanical sports ball catapult system, in accordance with aspects of the present disclosure. The drive mechanism 400 may comprise a drive piston arm 402, drive carriage 404, and a plurality of drive carriage sliders 406. The drive piston arm 402 may be pulled by the action of the arming mechanism 200 pulling on the arming cord 206 and its connected retaining ball 308. The movement of the retaining ball 308 may act on the drive piston arm 402, which may then move the drive carriage 404 along its path on the plurality of drive carriage sliders 406.

The drive carriage sliders may be attached to the drive mechanism 400 bracketry by a plurality of tensioning springs such that the drive carriage 404 is returned to its unloaded position when the firing mechanism 500 is engaged by a user. A spool cable 522 may attach the drive carriage 404 to the firing mechanism 500, and may act as the tension-releasing mechanism that causes a ball to be launched from the system. The tension acting on the various components of the drive mechanism 400 may be adjustable so as to alter the launch speed of a ball contained within the cradle mechanism 300.

Figure 11:
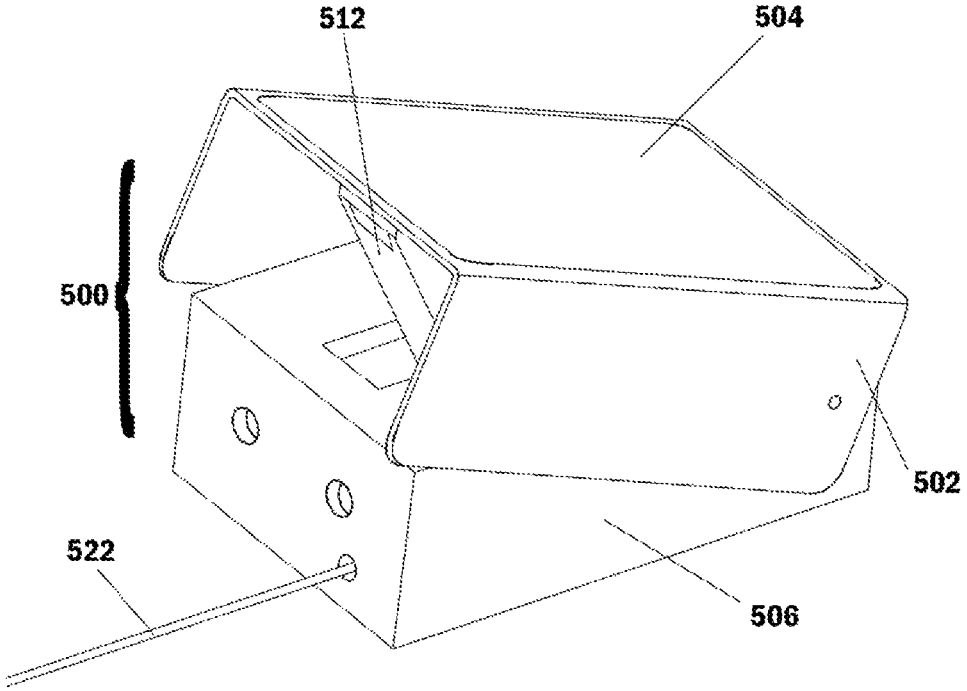
FIG. 11 illustrates a detailed view of a firing mechanism of a sports ball catapult, in accordance with aspects of the present disclosure.
Figure 12:
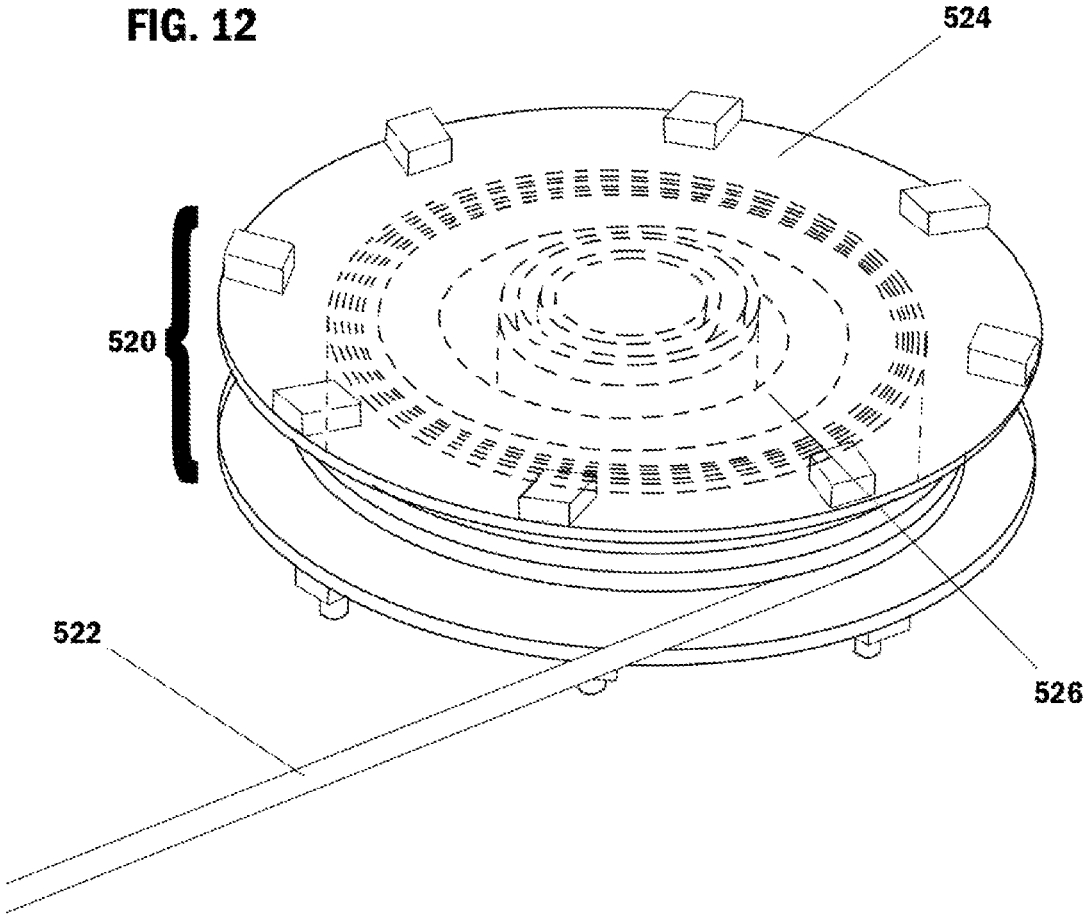
FIG. 12 illustrates a detailed view of a firing mechanism of a sports ball catapult, in accordance with aspects of the present disclosure.
Figure 13:
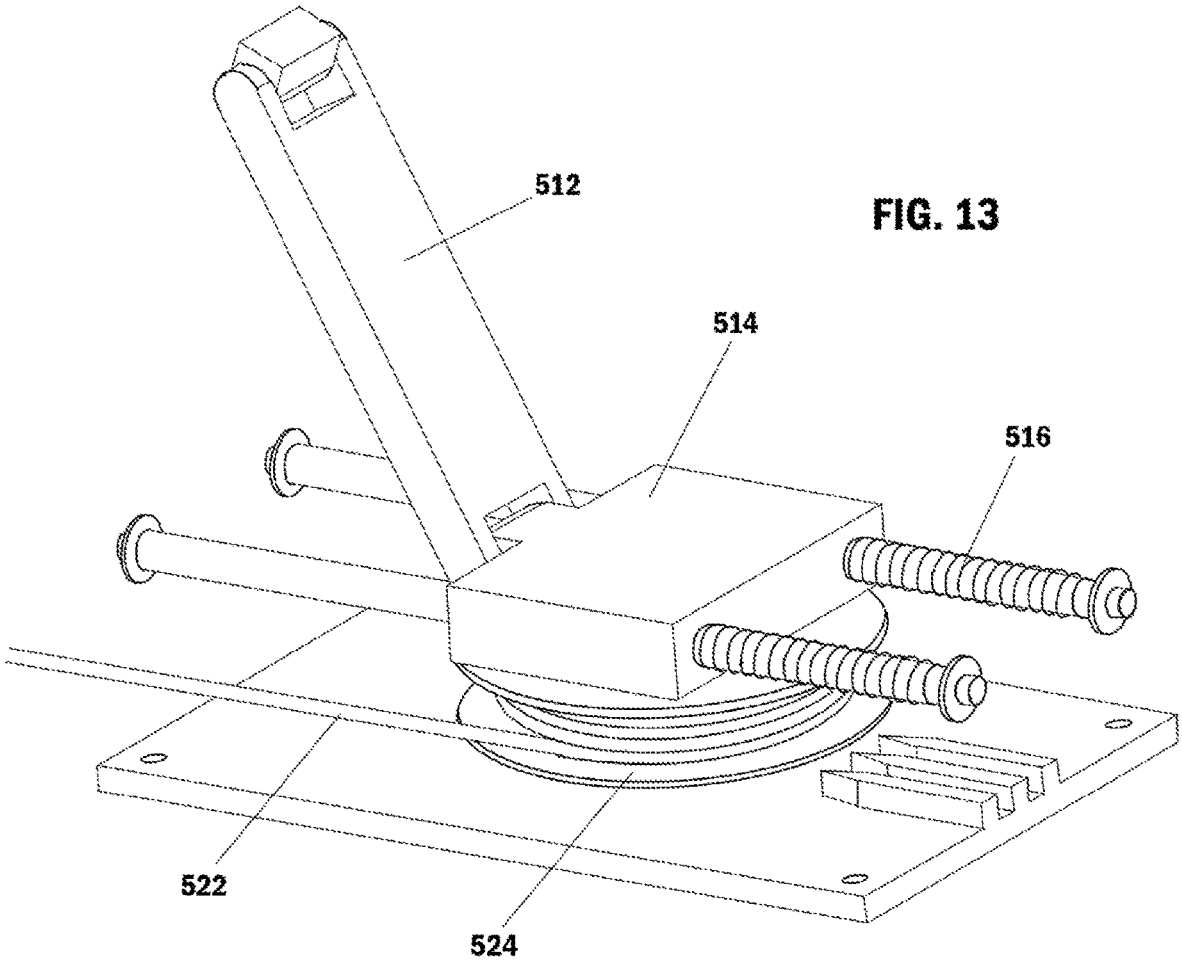
FIG. 13 illustrates a detailed view of a firing mechanism of a sports ball catapult, in accordance with aspects of the present disclosure.

The illustrations of FIGS. 11 through 13 illustrate a detailed view of a firing mechanism 500 of a mechanical sports ball catapult system, in accordance with aspects of the present disclosure. The firing mechanism 500 may comprise a firing mechanism cover 502, a traction pad 504, and a firing mechanism housing 506. Contained within the firing mechanism housing 506 may be a firing piston arm 512, a firing carriage 514, a plurality of firing carriage rails 516, and a spool assembly 520. The spool assembly 520 may comprise a spool cable 522, a spool pulley 524, and a spool spring 526.

The spool cable 522 may be wrapped around the spool pulley 524, and tension may be applied on the spool pulley 524 by pulling on the spool cable 522 and unwinding the spool spring 526. Such tension on the spool pulley 524 may be released by the action of the firing carriage 514 moving along the plurality of firing carriage rails 516. This action may be triggered by a user pressing on the firing piston arm 512, which may be connected to the firing mechanism cover 502. The firing mechanism cover 502 may be attached via a hinge mechanism to the firing mechanism housing 506 and may have a traction pad 504 attached thereon such that it substantially comprises a foot pedal trigger mechanism.

As discussed above, the action of the system is such that the arming mechanism 200 may be engaged by a user to apply tension on the cradle mechanism 300 and drive mechanism 400. The user may then place a ball into the cradle mechanism 300, and may launch the ball from the system by engaging the firing mechanism 500. The engaging of the firing mechanism 500 suddenly and rapidly releases the tension in the system, causing the cradle mechanism 300 to accelerate the ball into the air at the selected launch speed and launch angle. The entire system is contained within the main body 100, which is designed to provide an easily moveable, lightweight, and low maintenance solution for achieving such a purpose.

The mechanical sports ball catapult system may be substantially constructed of any suitable material or combination of materials, but typically is constructed of a resilient material or combination of materials such that the device is resistant to tearing and damage as a result of compression, stretching, twisting, heating, or submersion in water. As an example, and without limiting the scope of the present invention, various exemplary embodiments of the device may be substantially constructed of one or more materials of plastic, acrylic, polycarbonate, steel, aluminum, brass, fiberglass, carbon fiber, or combinations thereof.

In one embodiment the material of construction may vary from one component to the next within the device. By way of example, the structural support components of the mechanical sports ball catapult system may comprise a wear-resistant material of construction, such as metals, to increase the life-span and improve the rigidity of the system. The cradle mechanism, instead, may comprise a flexible material of construction, such as fabrics, to improve the tensioning ability of the system.

In one embodiment the mechanical sports ball catapult system may comprise a resilient material of construction that either comprises a material having antimicrobial properties or comprises a layering of antimicrobial material or coating. Antimicrobial properties comprise the characteristic of being antibacterial, biocidal, microbicidal, anti-fungal, antiviral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A mechanical sports ball catapult system, comprising:
a structural main body;
an arming mechanism;
a cradle mechanism;
a drive mechanism; and
a firing mechanism;
wherein said arming mechanism, said drive mechanism, said cradle mechanism, and said firing mechanism are attached to said structural main body;
wherein said structural main body further comprises a plurality of side panels, a rear panel, a plurality of cradle support frames, a plurality of vertical frames, a plurality of horizontal frames, an axle, and a plurality of wheels;
wherein a first of said plurality of vertical frames is attached to a first end of each of said plurality of horizontal frames, and a second of said plurality of vertical frames is attached to a second end of each of said plurality of horizontal frames;
wherein an upper end of each of said plurality of cradle support frames is attached to an upper end of each of said plurality of vertical frames, and a lower end of each of said plurality of cradle support frames is attached to a front end of said plurality of horizontal frames; and
wherein said plurality of cradle support frames, said plurality of vertical frames, and said plurality of horizontal frames comprise a system skeleton.

2. The invention of claim 1,
wherein said axle is installed through a lower end of each of said plurality of vertical frames;
wherein a first of said plurality of wheels is attached to a first end of said axle; and
wherein a second of said plurality of wheels is attached to a second end of said axle.

3. The invention of claim 2,
wherein said arming mechanism further comprises an arming pedal, a plurality of arming pedal arms, an arming cord, and a retaining ball;
wherein a first end of said arming pedal is attached to a first end of a first of said plurality of arming pedal arms, and a second end of said arming pedal is attached to a first end of a second of said plurality of arming pedal arms; and
wherein a first end of said arming cord is attached to said arming pedal.

4. The invention of claim 3,
wherein said cradle mechanism further comprises a cradle, a plurality of cradle tensioning cords, a plurality of fasteners, and a plurality of cradle angle brackets;
wherein a first end of each of said plurality of cradle tensioning cords is attached to said cradle; and
wherein a second end of each of said plurality of cradle tensioning cords is attached to one each of said plurality of fasteners.

5. The invention of claim 4,
wherein said drive mechanism further comprises a drive piston arm, a drive carriage, a plurality of drive carriage sliders, and a means for drive tensioning;

wherein said drive piston arm is attached to said drive carriage;

wherein said drive carriage slides along said plurality of drive carriage sliders; and wherein said drive carriage is attached to said means for drive tensioning.

6. The invention of claim 5, wherein said firing mechanism further comprises a firing mechanism cover, a firing piston arm, a firing carriage, a plurality of firing carriage rails, a means for firing tensioning, and a spool cable;

wherein said firing piston arm is attached to said firing carriage;

wherein said firing carriage slides along said plurality of firing carriage sliders;

wherein said firing carriage is attached to said means for firing tensioning; and wherein a first end of said spool cable is attached to said means for firing tensioning.

7. The invention of claim 6, wherein said retaining ball is attached to a middle portion of said arming cord;

wherein said retaining ball is placed within said arming mechanism;

wherein a second end of said arming cord is attached to said cradle;

wherein a second end of said spool cable is attached to a drive tension release attached to said drive carriage; and wherein each of said plurality of fasteners is attached to said plurality of cradle angle brackets; and wherein one each of said plurality of cradle angle brackets is attached to one each of said plurality of cradle support frames.

8. The invention of claim 7, wherein a user activates said arming mechanism by moving said arming pedal;

wherein said moving of said arming pedal activates said arming cord;

wherein said activation of said arming cord moves said retaining ball;

wherein said moving of said retaining ball activates said drive piston arm;

wherein said activating of said drive piston arm slides said drive carriage and increases a tension within said means for drive tensioning;

wherein said activation of said arming cord pulls said cradle;

wherein said pulling of said cradle increases a tension in each of said plurality of cradle tensioning cords;

wherein said sliding of said drive carriage pulls said spool cable; and wherein said pulling of said spool cable slides said firing carriage and increases a tension within said means for firing tensioning.

9. The invention of claim 8, wherein a user activates said firing mechanism by moving said firing mechanism cover;

wherein said moving of said firing mechanism cover releases said tension within said means for firing tension;

wherein said release of tension within said means for firing tension activates said drive tension release;

wherein said activation of said drive tension release releases said tension within said means for drive tensioning; and wherein said release of tension within said means for drive tensioning releases said tension in each of said plurality of cradle tensioning cords.

10. The invention of claim 9, wherein each of said cradle angle brackets further comprises a means for angle adjustment;

wherein each of said cradle support frames further comprises a means for receiving angle adjustments;

wherein one each of said cradle angle brackets is attached to one each of said cradle support frames by a sliding mechanism; and wherein a relative position of said cradle angle brackets on said cradle support frames may be adjusted by moving said means for angle adjustment from a first means for receiving angle adjustments to a second means for receiving angle adjustments.

11. The invention of claim 10, wherein a first of said plurality of side panels is attached to a first outer side of said system skeleton;

wherein a second of said plurality of side panels is attached to a second outer side of said system skeleton; and wherein said rear panel is attached to a rear side of said system skeleton.

12. The invention of claim 11, further comprising:

a handgrip;

wherein said handgrip is installed through an upper end of each of said plurality of vertical frames.

13. The invention of claim 12, wherein said tension in each of said plurality of cradle tensioning cords is adjustable.

14. The invention of claim 12, wherein said tension in said means for drive tensioning is adjustable.

15. The invention of claim 12, wherein said tension in said means for firing tensioning is adjustable.

* * * * *